US009970319B2

(12) United States Patent
Koonankeil et al.

(10) Patent No.: US 9,970,319 B2
(45) Date of Patent: May 15, 2018

(54) REDUCING VARIATION IN COOLING HOLE METER LENGTH

(71) Applicant: UNITED TECHNOLOGIES CORPORATION, Farmington, CT (US)

(72) Inventors: James M. Koonankeil, Marlborough, CT (US); Edward F. Pietraszkiewicz, Southington, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 301 days.

(21) Appl. No.: 14/702,840

(22) Filed: May 4, 2015

(65) Prior Publication Data

US 2015/0315930 A1 Nov. 5, 2015

Related U.S. Application Data

(60) Provisional application No. 61/988,526, filed on May 5, 2014.

(51) Int. Cl.
*F01D 25/12* (2006.01)
*F01D 5/18* (2006.01)

(52) U.S. Cl.
CPC ..... *F01D 25/12* (2013.01); *F01D 5/186* (2013.01); *F01D 5/187* (2013.01); *F05D 2220/32* (2013.01); *F05D 2230/20* (2013.01); *Y10T 29/49236* (2015.01)

(58) Field of Classification Search
CPC . F01D 25/12; F01D 5/18; F01D 5/183; F01D 5/186; F01D 5/187; F05D 2260/202
See application file for complete search history.

(56) References Cited

U.S. PATENT DOCUMENTS

| | | | | |
|---|---|---|---|---|
| 5,688,104 | A * | 11/1997 | Beabout | F01D 5/187 415/115 |
| 2002/0119045 | A1 | 8/2002 | Starkweather | |
| 2014/0271129 | A1* | 9/2014 | Mueller | F01D 5/186 415/115 |
| 2015/0152734 | A1* | 6/2015 | Ceglio | F01D 5/186 416/97 R |

FOREIGN PATENT DOCUMENTS

| | | | |
|---|---|---|---|
| EP | 1079071 | A2 | 2/2001 |
| EP | 1526250 | A2 | 4/2005 |
| WO | WO-9837310 | A1 | 8/1998 |
| WO | WO-2013163150 | A1 | 10/2013 |

OTHER PUBLICATIONS

Search Report and Opinion issued by the European Patent Office dated Jul. 19, 2013 for International Patent Application No. PCT/US2013/037753.
EP Search Report dated Sep. 10, 2015 for Application No. 15 16 6449.

* cited by examiner

*Primary Examiner* — Dwayne J White
*Assistant Examiner* — Peter T Hrubiec
(74) *Attorney, Agent, or Firm* — Cantor Colburn LLP

(57) ABSTRACT

An airfoil body includes an airfoil wall defined between an internal cavity surface and an external airfoil surface. A pad extends from the internal cavity surface. A cooling hole extends from the external airfoil surface, through the airfoil wall and through the pad for fluid communication through the airfoil wall.

14 Claims, 3 Drawing Sheets

REDUCING VARIATION IN COOLING HOLE METER LENGTH

CROSS-REFERENCE TO RELATED APPLICATION

This application claims the benefit of priority under 35 U.S.C. § 119(e) to U.S. Provisional Application No. 61/988,526, filed May 5, 2014, which is incorporated herein by reference in its entirety.

BACKGROUND OF THE INVENTION

1. Field of the Invention

The present disclosure relates to airfoils, and more particularly to cooled airfoils for blades and vanes in gas turbine engines.

2. Description of Related Art

Blades and vanes used in turbine sections of modern gas turbine engines can require active cooling in order to operate at gaspath temperatures in excess of the melting temperatures of the blades and vanes. One solution for providing the necessary cooling is to supply pressurized cooling air to a cavity within each blade or vane needing cooling, and to distribute the cooling air through cooling holes that pass from the cavity out to the gaspath.

In such applications, it is generally desirable to control the direction of the cooling flow over the surface of the blade or vane. The ratio of a cooling hole's length to its diameter, the L/D ratio, is a determining factor in how much control designers can expect to have over the cooling air flow. As trends for higher performance engines drive a need for thinner blade and vane walls, there is a tradeoff between losing control of cooling flow due to reduced L/D ratio for cooling holes, and the benefits of thinner blade and vane walls.

Such conventional methods and systems have generally been considered satisfactory for their intended purpose. However, there is still a need in the art for improved airfoils, e.g., for blades and vanes in gas turbine engines. The present disclosure provides a solution for this need.

SUMMARY OF THE INVENTION

An airfoil body includes an airfoil wall defined between an internal cavity surface and an external airfoil surface. A pad extends from the internal cavity surface. A cooling hole extends from the external airfoil surface, through the airfoil wall and through the pad for fluid communication through the airfoil wall.

In certain embodiments, the cooling hole includes a metering section defined in the pad and a diffuser diverging from the metering section to the external airfoil surface for distributing flow from the cooling hole to the external airfoil surface. It is contemplated that the metering section and the diffuser can meet at a depth within the airfoil wall between that of the pad at its farthest extent from the internal cavity surface and that of the external airfoil surface. It is also contemplated that the metering section and the diffuser can meet at a depth within the airfoil wall between a depth proximate that of the internal cavity surface proximate the pad and that of the external airfoil surface.

In another aspect, the cooling hole can be defined along an axis that is angled obliquely relative to the external airfoil surface proximate the cooling hole. The pad can have a thickness in a direction along an axis defined by the cooling hole, and wherein the cooling hole extends through the entire thickness of the pad. The pad can extend obliquely relative to the axis defined by the cooling hole.

It is contemplated that the airfoil body can include a plurality of cooling holes each extending through the airfoil wall into the internal cavity through a respective pad. The airfoil wall can have a variable thickness, wherein each of the cooling holes includes a metering section and a diffuser section diverging from the metering section to the external airfoil surface, i.e., none of the diffusers extends into the internal cavity without an intervening metering section.

A method of forming cooling holes in airfoils includes forming a pad extending from an internal cavity surface of an airfoil body. The method also includes forming a cooling hole through the airfoil body from an external airfoil surface thereof through the pad for fluid communication from an internal airfoil cavity to the external airfoil surface.

Forming a pad can include forming the pad in a common process with the airfoil body. The common process can include at least one of casting, forging, machining, additive manufacturing, and any other suitable process. Forming the pad can include forming the pad using a process with a first tolerance for location of the pad referenced from an internal casting ceramic core. Forming the cooling hole can include forming the cooling hole using a process with a second tolerance for location of the cooling hole referenced from a position on the external airfoil surface, e.g., a relationship exists between the internal core position and the external airfoil surface that can be established during the process of manufacturing the airfoil body. The first and second tolerances can be made to stack to ensure the placement of the cooling hole through the pad.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
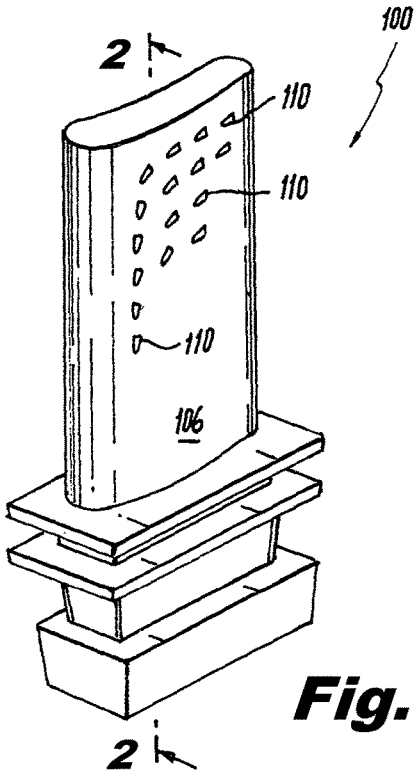
FIG. 1 is a perspective view of an exemplary embodiment of a turbine blade constructed in accordance with the present disclosure, showing the diffuser outlets of cooling holes in the external airfoil surface.
Figure 2:
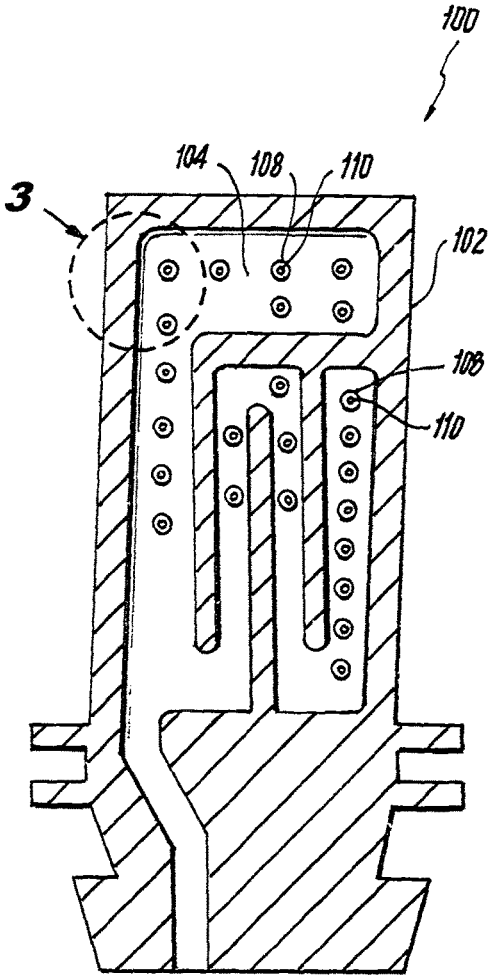
FIG. 2 is a cross-sectional side elevation view of the turbine blade of FIG. 1, showing the internal cavity with pads extending inward from the internal cavity surface, where the cooling holes extend through the pads.

Reference will now be made to the drawings wherein like reference numerals identify similar structural features or aspects of the subject disclosure. For purposes of explanation and illustration, and not limitation, a partial view of an exemplary embodiment of an airfoil body in accordance with the disclosure is shown in FIGS. 1 and 2 and is designated generally by reference character 100. Other embodiments of airfoil bodies in accordance with the disclosure, or aspects thereof, are provided in FIGS. 3-7, as will be described. The systems and methods described herein can be used for improving cooling hole performance in thin walled turbine vanes and blades, for example.

Figure 3:
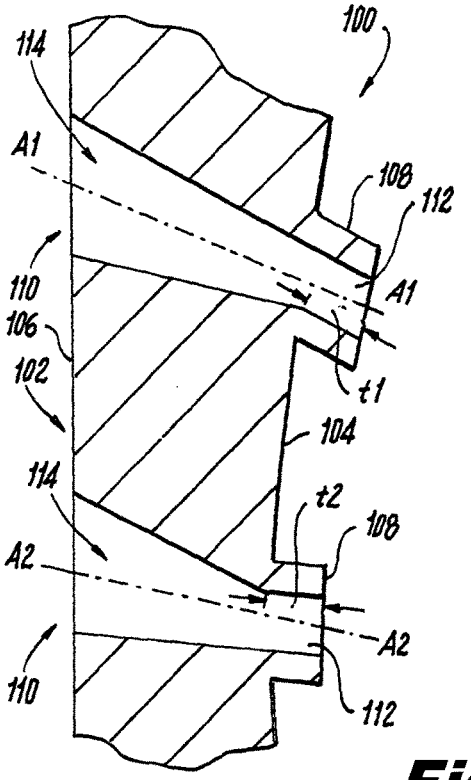
FIG. 3 is a cross-sectional front elevation view of two of the cooling holes of FIG. 2, showing the cooling hole axes.

An airfoil body 100 includes an airfoil wall 102, identified in FIG. 2, defined between an internal cavity surface 104 and an external airfoil surface 106, identified in FIG. 1. A plurality of pads 108, not all of which are labeled in FIG. 2 for sake of clarity, extends from internal cavity surface 104. As shown in FIG. 3, a cooling hole 110 extends from external airfoil surface 106, through airfoil wall 102 and through each pad 108 for fluid communication through airfoil wall 102. There are a plurality of such cooling holes 110 in airfoil body 100, although not all are labeled with reference characters in FIGS. 1 and 2 for sake of clarity.

With continued reference to FIG. 3, each cooling hole 110 includes a metering section 112 defined in pad 108 and a diffuser 114 diverging from metering section 112 to external airfoil surface 106 for distributing flow from cooling hole 110 to external airfoil surface 106. As will be described further below with reference to FIG. 7, the cooling hole structure shown in FIG. 3 allows for diffusers 114 to be fully formed, without the diffusers 114 extending all the way through airfoil wall 102, which would otherwise result in a reduced L/D ratio and a lack of metering.

Each cooling hole 110 in FIG. 3 is defined along a respective axis A1 and A2 that is angled obliquely relative to external airfoil surface 106 proximate the respective cooling hole 110. Each pad 108 has a thickness t1 and t2 in a direction along the axis A1 and A2 defined by the respective cooling hole 110. Each cooling hole 110 extends through the entire thickness t1 and t2 of the respective pad 108. The pad 108 can extend obliquely relative to the respective axis defined by the respective cooling hole 110, or can extend parallel to the respective axis. For example, the pad 108 corresponding to axis A1 in FIG. 3 extends parallel to axis A1, even though this makes the pad 108 oblique relative to the local internal cavity surface 104. The pad 108 corresponding to axis A2, on the other hand, extends obliquely relative to axis A2. It should also be noted that airfoil wall 102 has a variable thickness, and while depicted in FIG. 3 with a curved internal cavity surface 104, external airfoil surface 106 can be curved as well.

Figure 4:
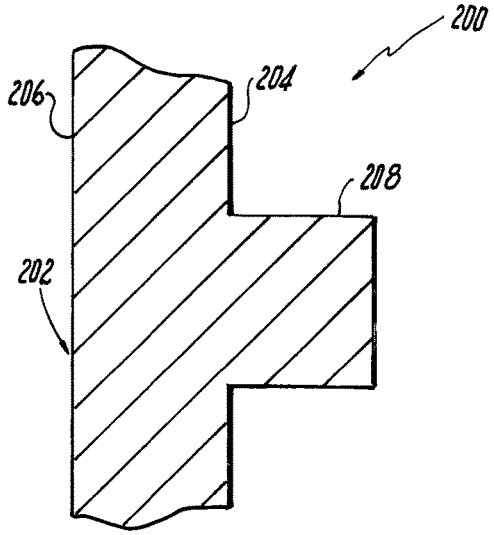
FIG. 4 is a cross-sectional front elevation view of a portion of another exemplary airfoil in accordance with the present disclosure, an airfoil wall and pad formed.

With reference now to FIG. 4, a method of forming cooling holes in airfoils is described. In FIG. 4, an airfoil body 200 is shown, similar to airfoil body 100 described above, including airfoil wall 202, external airfoil surface 206, internal cavity surface 204, and a pad 208. The method includes forming pad 208 extending from internal cavity surface 204 of airfoil body 200. Forming pad 208 can include forming pad 208 in a common process with the airfoil body 200. The common process can include at least one of casting, forging, machining, additive manufacturing, and any other suitable process.

Figure 5:
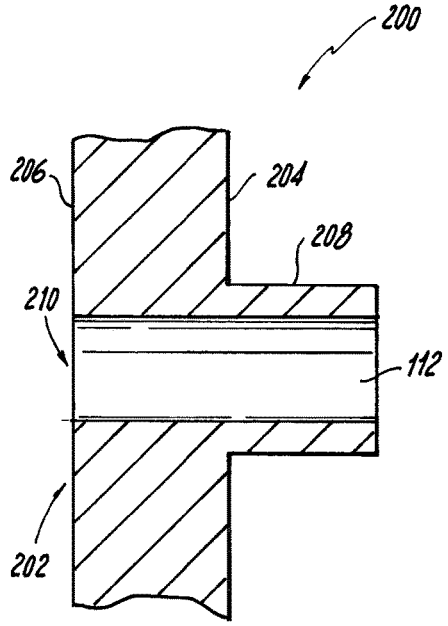
FIG. 5 is a cross-sectional front elevation view of a portion of the airfoil of FIG. 4, showing a metering section of the cooling hole formed through the pad and airfoil wall.
Figure 6:
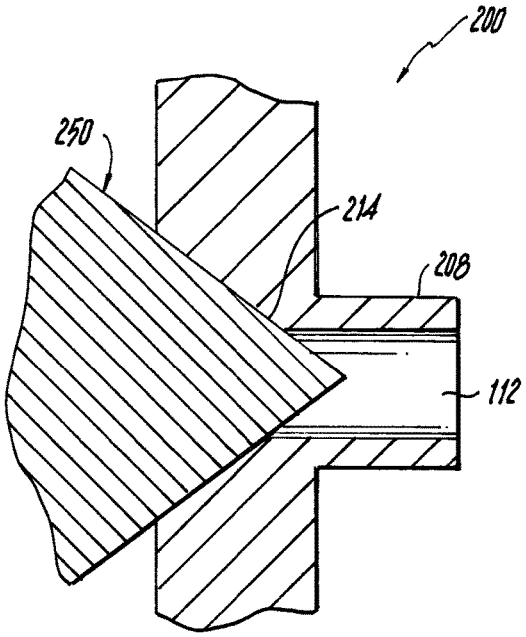
FIG. 6 is a cross-sectional front elevation view of a portion of the airfoil of FIG. 4, showing a tool forming the diffuser of the cooling hole.
Figure 7:
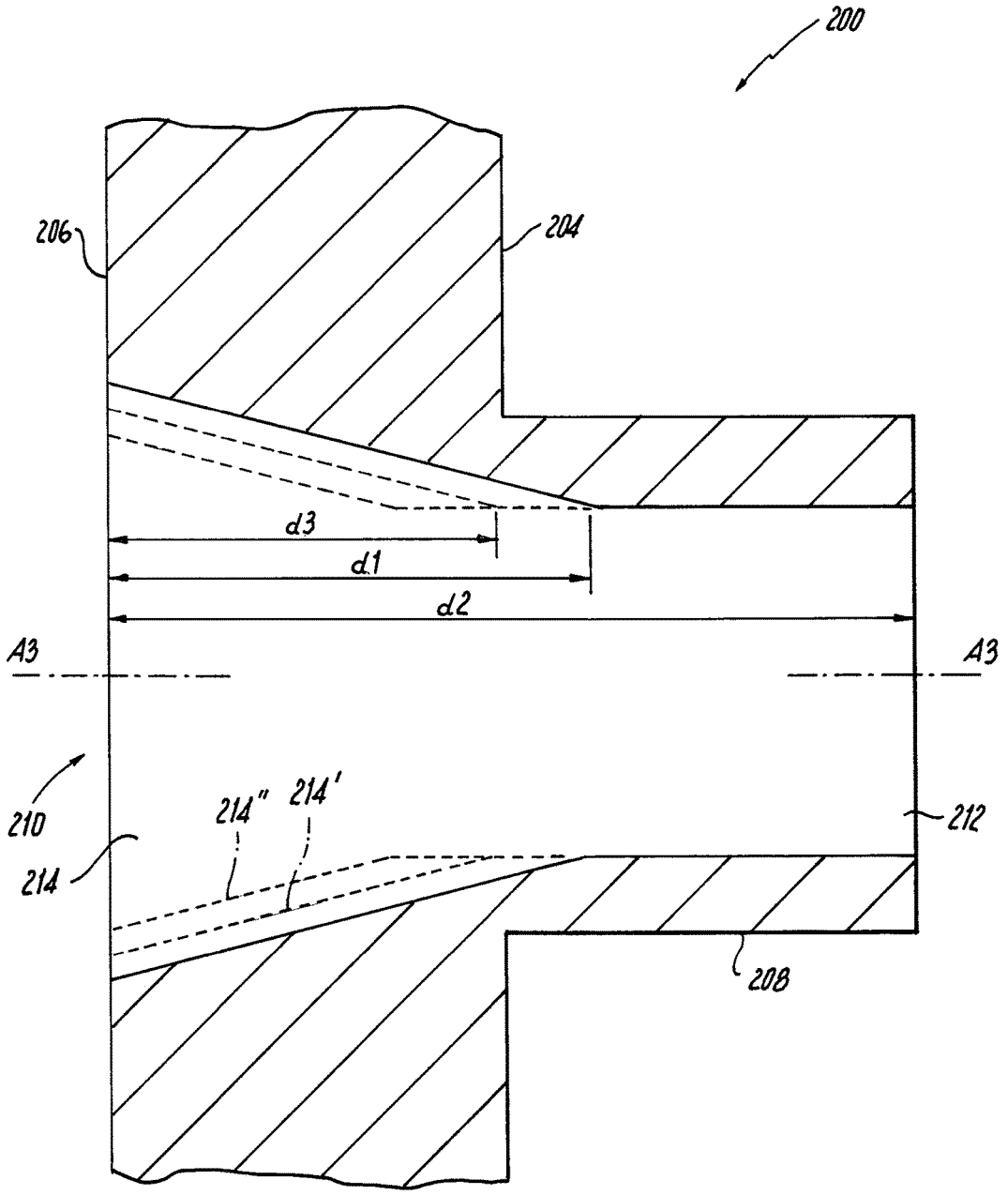
FIG. 7 is a cross-sectional front elevation view of a portion of the airfoil of FIG. 4, showing the depth of the transition between the metering section and the diffuser.

Referring now to FIGS. 5-6, the method also includes forming a cooling hole 210 through airfoil body 202 from an external airfoil surface 202 thereof through pad 208 for fluid communication from an internal airfoil cavity to the external airfoil surface 206. As shown in FIG. 5, the metering section 212 can be formed, for example by drilling, and as shown in FIG. 6, diffuser 214 can be formed by milling with a tool 250 having the proper diffuser shape. It is also contemplated that any other suitable process for forming metering section 212 and diffuser 214 can be used, such as using an electrical discharge machining (EDM) tool having the complete geometry for metering section 212 and diffuser 214 on a single tool. Any suitable hole drilling processes can be used to form cooling hole 210, such as laser cutting, water jet cutting, or the like. Moreover, while explained above in an exemplary order, those skilled in the art will readily appreciate that the processes described above can be performed in any suitable matter, or in one shot, as in forming the entire part 200 with additive manufacturing techniques or casting techniques for example. The resulting geometry is shown in FIG. 7.

Forming pad 208 can include forming pad 208 using a process with a first tolerance for location of the pad referenced from an internal casting ceramic core, or any suitable internal feature e.g., on internal cavity surface 204. Forming cooling hole 210 can include forming cooling hole 210 using a process with a second tolerance for location of cooling hole 210 referenced from a position on external airfoil surface 206, e.g., a relationship exists between the internal core position and the external airfoil surface 206 that can be established during the process of manufacturing the airfoil body 200. The first and second tolerances can be made to stack to ensure the placement of cooling hole 210 through pad 208.

It is contemplated that the metering section and the diffuser can meet at a depth dl within the airfoil wall between the depth d2 of the pad 208 at its farthest extent from the internal cavity surface 204, e.g., the innermost surface of pad 208, and the depth of external airfoil surface 206, which is zero when referencing depth from external airfoil surface 206. As depicted in the example shown in FIG. 7, the depth dl wherein the metering section and diffuser meet is deeper than depth d3, which is the depth of the internal cavity surface 204 at the base of pad 208. In other words, as depicted in FIG. 7, the diffuser 214 extends deeper than the thickness of the wall of airfoil body 200 would otherwise permit if pad 208 were not present, because there would be no room for a metering section. It is also contemplated that the metering section 212 and the diffuser 214 can meet at a depth dl equal to depth d3 or shallower than d3, as indicated by the broken lines representing diffusers 214' and 214" in FIG. 7, respectively. In all three of these configurations, pad 208 ensures an adequate length of metering section 212 to establish a proper L/D ratio. The dimensions of pad 208 can be tailored to accommodate a proper length of metering section 212 given a local wall thickness where the cooling hole is to be located.

One potential advantage of using the systems and methods described herein is the ability to provide appropriately diffused cooling holes in thinner airfoil walls that in traditional techniques. Using traditional techniques, the diffuser size and shape required for suitable diffused cooling holes can result in the diffuser being plunged nearly or all the way into the inner cavity, resulting in little or no metering section, if the airfoil walls are too thin. The metering section L/D ratio is compromised in such situations, and thin portions of variable thickness airfoils may not be properly cooled as a result. The systems and methods described herein can be used to ensure fully developed cooling holes with appropriate diffusers and metering sections even in airfoils with thin and/or variable wall thickness. The additional material provided by the pads 108 and 208 allows the metering sections 112 and 212 of the cooling holes 110 and 210 to be fully developed so that the proper L/D ratios may be obtained, which can result in more consistent airflow and reduced variation of critical part performance.

While shown and described in the exemplary context of round cooling holes and pads, those skilled in the art will readily appreciate that shaped cooling holes and pads can be used without departing from the scope of this disclosure. It should be noted that the effects of traditional techniques described above are most significant in shaped holes, but can still exist with simple through holes with round cross-sections.

While shown and described in the exemplary context of turbine blades, those skilled in the art will readily appreciate that the techniques described herein can readily be applied in any other suitable application, e.g., in components with cooling holes, such as turbine vanes, compressor vanes, compressor blades, combustor liners, and blade outer air seals (BOAS). Moreover, while shown and described in the exemplary context of airfoils, those skilled in the art will readily appreciate that non-airfoil components, e.g., gas turbine engine components, can also be used without departing from the scope of this disclosure.

The methods and systems of the present disclosure, as described above and shown in the drawings, provide for airfoils with superior properties including improved cooling flow control in thin walled blades and vanes, for example. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An airfoil body comprising:

an airfoil wall defined between an internal cavity surface of the airfoil wall and an external airfoil surface of the airfoil wall; and a pad extending from the internal cavity surface of the airfoil wall, wherein a cooling hole extends from the external airfoil surface, through the airfoil wall and through the pad for fluid communication through the airfoil wall, wherein the cooling hole includes a metering section defined in the pad and a diffuser diverging from the metering section to the external airfoil surface for distributing flow from the cooling hole to the external airfoil surface, wherein the diffuser has a length greater than a thickness of the airfoil wall.

2. An airfoil body as recited in claim 1, wherein the cooling hole is defined along an axis that is angled obliquely relative to the external airfoil surface proximate the cooling hole.

3. An airfoil body as recited in claim 1, wherein the pad has a thickness in a direction along an axis defined by the cooling hole, and wherein the cooling hole extends through the entire thickness of the pad.

4. An airfoil body as recited in claim 1, wherein the pad extends obliquely relative to an axis defined by the cooling hole.

5. An airfoil body as recited in claim 1, wherein the cooling hole is a first cooling hole, and the airfoil body further comprises a plurality of additional cooling holes each extending through the airfoil wall into the internal cavity through a respective pad.

6. An airfoil body as recited in claim 5, wherein the airfoil wall has a variable thickness, wherein each of the cooling holes includes a metering section and a diffuser section diverging from the metering section to the external airfoil surface.

7. A method of forming cooling holes comprising:

forming a pad extending from an internal cavity surface of a body; and forming a cooling hole through the body from an external surface thereof through the pad for fluid communication from an internal cavity to the external surface, wherein the body is an airfoil body, and wherein the cooling hole includes a metering section defined in the pad and a diffuser diverging from the metering section to the external airfoil surface for distributing flow from the cooling hole to the external airfoil surface, wherein the diffuser has a length greater than a thickness of the body.

8. A method as recited in claim 7, wherein forming a pad includes forming the pad in a common process with the body.

9. A method as recited in claim 8, wherein the common process includes at least one of casting, forging, machining, and additive manufacturing.

10. A method as recited in claim 7, wherein forming the pad includes forming the pad using a process with a first tolerance for location of the pad referenced from an internal casting ceramic core, wherein forming the cooling hole includes forming the cooling hole using a process with a second tolerance for location of the cooling hole referenced from a position on the external surface, wherein the first and second tolerances stack to ensure the placement of the cooling hole through the pad.

11. A component configured to be cooled with cooling holes comprising:

a wall defined between an internal cavity surface and an external wall surface; and a pad extending from the internal cavity surface of the wall, wherein a cooling hole extends from the external wall surface, through the wall and through the pad for fluid communication through the wall, wherein the cooling hole includes a metering section defined in the pad and a diffuser diverging from the metering section to the external wall surface for distributing flow from the cooling hole to the external wall surface, wherein the diffuser has a length greater than a thickness of the wall.

12. A component as recited in claim 11, wherein the cooling hole is defined along an axis that is angled obliquely relative to the external surface proximate the cooling hole.

13. A component as recited in claim 11, wherein the pad has a thickness in a direction along an axis defined by the cooling hole, and wherein the cooling hole extends through the entire thickness of the pad.

14. A component as recited in claim 11, wherein the pad extends obliquely relative to an axis defined by the cooling hole.

* * * * *